US011700879B2

(12) United States Patent
Shoor et al.

(10) Patent No.: US 11,700,879 B2
(45) **Date of Patent: *Jul. 18, 2023**

(54) SMOKING ACCESSORY WITH FILTER AND FILTER HAVING A FLAVOR CAPSULE

(71) Applicant: Good Tree International, Inc., Ontario, CA (US)

(72) Inventors: Kunal Shoor, Ontario, CA (US); Brandon Puett, Ontario, CA (US)

(73) Assignee: Good Tree International, Inc., Ontario, CA (US)

( * ) Notice: Subject to any disclaimer, the term of this patent is extended or adjusted under 35 U.S.C. 154(b) by 34 days.

This patent is subject to a terminal disclaimer.

(21) Appl. No.: 17/187,553

(22) Filed: Feb. 26, 2021

(65) Prior Publication Data

US 2022/0273024 A1 Sep. 1, 2022

(51) Int. Cl.

| | |
|---|---|
| ***A24D 3/06*** | (2006.01) |
| ***A24D 3/08*** | (2006.01) |
| ***A24D 3/04*** | (2006.01) |
| ***A24D 1/02*** | (2006.01) |

(52) U.S. Cl.

CPC ..... *A24D 3/061* (2013.01); *A24D 1/02* (2013.01); *A24D 3/048* (2013.01); *A24D 3/08* (2013.01)

(58) Field of Classification Search

CPC ..... A24D 3/061; A24D 3/048; A24D 3/08; A24D 1/02; A24D 3/18; A24D 1/022

See application file for complete search history.

(56) References Cited

U.S. PATENT DOCUMENTS

| | | | | |
|---|---|---|---|---|
| 3,199,515 A | | 8/1965 | Lowe | |
| 3,490,461 A | | 1/1970 | Osmalov | |
| 3,550,508 A | * | 12/1970 | Sprinkle | A24D 3/0216 131/342 |
| 3,910,288 A | | 10/1975 | Hammersmith | |
| 4,865,056 A | | 9/1989 | Tamaoki | |
| 4,889,144 A | | 12/1989 | Tateno | |
| 5,568,819 A | | 10/1996 | Gentry | |
| 6,041,790 A | | 3/2000 | Smith | |

(Continued)

FOREIGN PATENT DOCUMENTS

| | | |
|---|---|---|
| CN | 101203148 B | 9/2012 |
| GB | 2549803 | 11/2017 |

(Continued)

OTHER PUBLICATIONS

English machine translation of abstract of CN 103726410A; Apr. 16, 2014; Liu; 2 pages. (Year: 2014).*

(Continued)

*Primary Examiner* — Linda L Gray

(74) *Attorney, Agent, or Firm* — Sheppard Mullin Richter & Hampton LLP

(57) ABSTRACT

A device for use while burning smoking material and inhaling the resulting smoke is disclosed. The device can include a filter having a recess formed in a surface of a body along a curved face extending from the first end to the second end, the recess extending radially into the body. The smoking accessory can include a capsule containing a flavoring agent disposed within the recess. The device may be received by a first end a tubular member formed to receive a smoking material, that when burned passes smoke into the device.

17 Claims, 2 Drawing Sheets

(56) References Cited

U.S. PATENT DOCUMENTS

| | | | | |
|---|---|---|---|---|
| 7,152,609 | B2 | 12/2006 | Li | |
| 7,578,298 | B2 | 8/2009 | Karles | |
| 7,793,665 | B2 | 9/2010 | Dube | |
| 7,827,997 | B2 | 11/2010 | Crooks | |
| 7,836,895 | B2 | 11/2010 | Dube | |
| 7,856,992 | B2 | 12/2010 | Zhou | |
| 7,878,962 | B2 | 2/2011 | Karles | |
| 7,984,719 | B2 | 7/2011 | Dube | |
| 8,051,859 | B2 | 11/2011 | Yadav | |
| 8,066,011 | B2 | 11/2011 | Clark | |
| 8,118,035 | B2 | 2/2012 | Miser | |
| 8,235,056 | B2 | 8/2012 | Zhuang | |
| 8,356,607 | B2 | 1/2013 | Inoue | |
| 8,459,272 | B2 | 6/2013 | Karles | |
| 8,739,802 | B2 | 6/2014 | Fagg | |
| 9,010,337 | B2 | 4/2015 | Kobal | |
| 9,066,541 | B2 | 6/2015 | Allen | |
| 9,107,452 | B2 | 8/2015 | Deevi | |
| 9,119,421 | B2 | 9/2015 | Li | |
| 9,149,072 | B2 | 10/2015 | Conner | |
| 9,307,788 | B2 | 4/2016 | Dube | |
| 9,332,786 | B2 | 5/2016 | Yokogawa | |
| 9,554,594 | B2 | 1/2017 | Clark | |
| 9,872,517 | B2 | 1/2018 | Reed | |
| 9,907,335 | B2 | 3/2018 | Karles | |
| 10,321,710 | B2 | 6/2019 | Kobal | |
| 10,357,057 | B2 | 7/2019 | Kadiric | |
| 10,568,356 | B2 | 2/2020 | Karles | |
| 10,609,955 | B2 | 4/2020 | Beard | |
| 10,736,351 | B2 | 8/2020 | Kaihatsu | |
| 10,765,143 | B2 | 9/2020 | Mishra | |
| 10,893,700 | B2 | 1/2021 | Mishra | |
| 11,019,842 | B2 | 6/2021 | Dube | |
| 11,076,632 | B1 | 8/2021 | Ormaza | |
| 11,311,044 | B2 * | 4/2022 | Shoor | A24D 3/048 |
| 2006/0078608 | A1 | 4/2006 | Gilinski | |
| 2006/0135335 | A1 | 6/2006 | Dawson | |
| 2006/0174901 | A1 | 8/2006 | Karles | |
| 2007/0012327 | A1 | 1/2007 | Karles | |
| 2007/0068543 | A1 | 3/2007 | Chen | |
| 2007/0246054 | A1 | 10/2007 | Gedevanishvili | |
| 2012/0024303 | A1 | 2/2012 | Sugai | |
| 2012/0097179 | A1 | 4/2012 | Kesselman | |
| 2012/0255569 | A1 | 10/2012 | Beard | |
| 2013/0333710 | A1 | 12/2013 | Brown | |
| 2014/0053855 | A1 | 2/2014 | Hartmann | |
| 2014/0332014 | A1 | 11/2014 | Penrose | |
| 2015/0027477 | A1 | 1/2015 | Yoshino | |
| 2015/0164133 | A1 | 6/2015 | Davis | |
| 2015/0296875 | A1 | 10/2015 | Camus | |
| 2017/0000185 | A1 | 1/2017 | Risso | |
| 2018/0160724 | A1 | 6/2018 | Guyard | |
| 2020/0146340 | A1 | 5/2020 | Alderman | |

FOREIGN PATENT DOCUMENTS

| | | | | |
|---|---|---|---|---|
| KR | 20070100422 | * | 10/2007 | A24D 3/061 |
| UA | 105677 C2 | | 6/2014 | |
| WO | 03009711 | | 2/2003 | |
| WO | WO2015014610 A2 | * | 2/2015 | |
| WO | 2015091792 | | 6/2015 | |
| WO | 2020142002 | | 7/2020 | |
| WO | 2022129613 | | 6/2022 | |

OTHER PUBLICATIONS

English machine translation of TW202041156A; Nov. 16, 2020; Kiew; 46 pages. (Year: 2020).*

English machine translation of UA105677C2; Jun. 10, 2014; 38 pages. (Year: 2014).*

English machine translation of CN105813483A; Jul. 27, 2016; Reed; 19 pages. (Year: 2016).*

English machine translation of JP2017503477A1; Feb. 2, 2017; 13 pages. (Year: 2017).*

English machine translation of WO2011086751A1; Kato; Jul. 21, 2011; 31 pages. (Year: 2011).*

English machine translation of abstract of WO9725886A1; Roca; Jul. 24, 1997; 4 pages. (Year: 1997).*

English machine translation of KR20070100422; Jan. 10, 2007; 14 pages; Karles. (Year: 2007).*

King Palm "About Us" web page at <URL: https://kingpalm.com/about>, Feb. 2019, retrieved from the Internet at <URL: https://web.archive.org/web/20190205084640/https://kingpalm.com/about#>, on Nov. 8, 2022, 4 pages.

King Palm "High Quality Natural Palm Leaf Blunts" web page at <URL: https://kingpalm.com/>, Jun. 12, 2018, retrieved from the Internet at <URL: https://web.archive.org/web/20180612075453/https://kingpalm.com/>, on Nov. 8, 2022, 4 pages.

King Palm; Feb. 1, 2021; 1 page. (Year: 2021).

Natural Blunt Wraps; 2020; 28 pages. (Year: 2020).

Wayback Machine for cordia Natural Blunt Wraps; 2020; 1 page. (Year: 2020).

Wayback Machine for cordia Wikipedia; 2004; 1 page. (Year: 2004).

Wayback Machine for King Palm; Feb. 1, 2021; 1 page. (Year: 2021).

Wikipedia for cordia; 2004; 8 pages. (Year: 2004).

Amazon King Palm, Jul. 24, 2018 (Year: 2018), 2 pages.

* cited by examiner

SMOKING ACCESSORY WITH FILTER AND FILTER HAVING A FLAVOR CAPSULE

BACKGROUND

Technical Field

This disclosure relates to flavored smoking materials. More specifically, this disclosure relates to a filter having a flavor capsule contained within a filter element.

Related Art

Hand-rolled cigarettes, cigars, or cigarillos generally do not have an incorporated filter. Filters can be purchased and included in such a hand-rolled smoke, but these are commonly formed from synthetic materials such as cellulose acetate (a plastic) and rayon. The cellulose acetate tow fibers are thinner than sewing thread, white, and packed tightly together to form a filter element and included in the hand-rolled smoke. Burning or inhaling such synthetic fibers can create hazardous situation for the smoker. In addition, flavors are not easily added to hand-rolled cigarettes, cigars, or cigarillos.

SUMMARY

One aspect of the disclosure provides a smoking accessory. The smoking accessory can include a filter having a body extending from a first end to a second end. The filter can have a recess formed in a surface of the body along a curved face extending from the first end to the second end, the recess extending radially into the body. The smoking accessory can include a capsule containing a flavoring agent disposed within the recess.

The filter can be formed from one or more of dried leaf, corn husk, and paper. The filter can have a filter wrapper and a filter element. The body can be at least one of a cylindrical body and a truncated conical body. The filter can be independently wrapped and contained by friction within a tubular member. Crushing the capsule disperses the flavoring agent within the filter to impart a flavor into the smoke. The recess can completely penetrate the filter.

Another aspect of the disclosure provides a filter. The filter comprises a body and a recess formed in a surface of the body, the recess extending radially through the body. The filter can have a capsule containing a flavoring agent disposed within the recess. The body can be at least one of a cylindrical body and a truncated conical body.

Other features and advantages will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
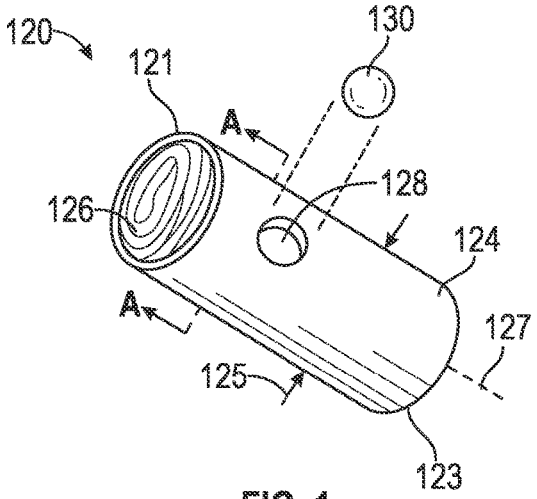
FIG. 1 is a perspective view of an embodiment of a filter.

FIG. 1 is a perspective view of an embodiment of a filter 120. In the illustrative example shown in FIG. 1, the filter 120 can have a cylindrical body/shape having an outer diameter 125 extending from a first end 121 to a second end 123. The filter 120 can have a central axis 127 following an imaginary line through the center of the filter 120 from the first end 121 to the second end 123. The description refers to axial and radial directions. Axial refers to directions along the central axis 127, while radial refers to a direction orthogonal to the central axis 127. The filter 120 may be configured to be received within an end of a tubular member in an interference or friction fit, for example, as described below in connection to FIGS. 6-8. In some examples, the filter 120 may be rolled into corn husk, dried leaf, or paper member (e.g., also referred to a wrap) when forming the tubular member. That is, in various embodiments, the filter 120 may be a distinct body that may, while used in conjunction with a separately provided tubular member, operate as a smoking accessory acting on smoke drawn through the filter 120.

The filter 120 can have a filter wrapper 124 (e.g., a plug wrap) enclosing a filter element 126. The filter element 126 can be formed from natural fibers. In some examples, the filter element 126 can be formed by rolling corn husks. The corn husks for the filter element 126 can be shredded and then rolled (e.g., hand-rolled or machine-rolled) into a cylindrical shape, forming the filter element 126. In some examples, the filter element 126 maybe paper material (e.g., any paper material, such as but not limited to, hemp, wood pulp, or the like). The paper material may be provided as strips of paper that can be cut and rolled (e.g., hand-rolled or machine-rolled) into a cylindrical shape. In some implementations, the filter element 126 can be held in the cylindrical shape by the filter wrapper 124. The filter wrapper 124 can be a section of ordinary paper (e.g., kraft paper and the like) wrapped around the filter element 126. In other implementations, the filter 120 can be completely formed of corn husk without any paper. In some other implementations, the filter wrapper 124 can be one or more sections (e.g., lengths) of string formed from natural fibers. The string can be wrapped and tied around, for example, the ends of the filter element 126 to maintain a round shape.

In some implementations, the filter wrapper can be rolled around a shaped form and dried in place to form the body of the filter 120. In some examples, the filter wrapper can be (fully or partially) dried and then rolled into the desired shape. Optionally, the filter 120 can be secured in a tubular form, for example with a ring or string (not shown). The ring or string can be a section of paper or other appropriate fastener wrapped around and adhered to itself holding the filter wrapper in a hollow form/tubular shape and prevent the filter wrapper from unwrapping. The ring or string can further be adhered to the filter wrapper to maintain the tubular shape.

Embodiments described throughout this disclosure (for example, filter 120 and filter 520 described below) may provide various non-limiting advantages. For example, the filter and filter element packed therein may be configured to ensure that no loose smoking material inadvertently falls out of the tubular member. Additionally, the filter member 126 may prevent unwanted oils from entering a mouth of a user, for example, by absorbing oils produced by burning smoking material into the material of the filter element 126. Furthermore, implementations of filter 120 that employ corn husk as the filter wrapper 124 and/or filter element 126 may provide advantages over conventional paper, for example, by providing an all-natural smoking experience through the use of non-GMO, organic corn husk filter material. Additionally, corn husk material is exceptionally durable and resistant to tearing, enabling a user to manipulate the material free from damage concerns.

Figure 2:
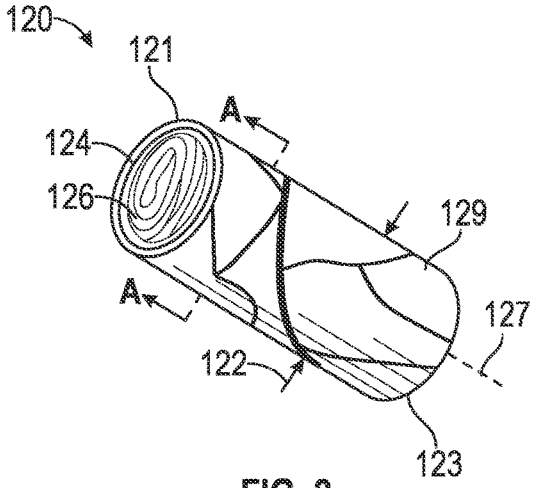
FIG. 2 is a perspective view of the filter of FIG. 1 including an outer casing.

FIG. 2 is a perspective view of an embodiment of the filter 120 including an outer casing 129. The filter 120 can have a tubular member formed as the outer casing 129 having an outer diameter of 122. The outer casing 129 can extend from the first end 121 to the second end 123.

The outer casing 129 can include elongated internal cavity extending between the first end 121 and the second end 123 along the central axis 127. The internal cavity can receive a filter wrapper 124 and filter element 126. The outer diameter 125 can be approximately equal to the diameter of the elongated internal cavity of the outer casing. The filter wrapper 124 and filter element 126 may be received within the first end 121 of the outer casing in an interference or friction fit. In the illustrative example of FIG. 2, the outer casing 129 overlaps in the radial direction with the filter wrapper 124 and filter element 126 along the entire length of the filter wrapper 124. In another example, the outer casing 129 may overlap with a portion of the filter wrapper 124 that is less than the entire length, thereby leaving the remaining portion or portions of the filter wrapper exposed.

In some implementations, the outer casing 129 can formed of dried leaf, corn husk, paper (e.g., kraft paper), and the like. In some examples, dried leaf can be any natural plant leaf that can be rolled into a tube. In some examples, the dried leaf can be a tree or plant leaf such as, cordia, manjack, bocote, palm, or other leaves. Cordia is a primary example used herein, but is not limiting on the disclosure. Cordia can include flowering plants (e.g., shrubs and trees) in the borage family, Boraginaceae. In general, the dried leaf can be a pure and all natural leaf (i.e., no additives), without glue or other adhesives, and green leaf. The dried leaf can also be tobacco free. The dried leaf can provide a resilient and aesthetically appealing green that burns slowly. When the outer casing is formed of corn husk, the corn husk can be rolled to form the tubular shape of the outer casing 129. The corn husk may pure and all natural (e.g., organic with no additives and non-GMO), without glue or other adhesives. The corn husk may be resilient to tearing and durable to provide a casing that holds the filter 120 together.

The outer casing 129 can be rolled around a form and dried in place to form the tubular member shape of the filter. In some examples, dried leaf or corn husk can be (fully or partially) dried and then rolled into the desired shape. The outer casing 129 can be secured in a tubular form with a ring or string (not shown). The ring or string can be a section of paper or other appropriate fastener wrapped around and adhered to itself holding the outer casing in its hollow form/tubular shape and prevent the filter from unwrapping. The ring can further be adhered to the outer casing 129 to maintain the tubular shape.

In an example method of forming the filter 120, the material of the filter element 126 may be layered on top of the material of the filter wrapper 124, which is layered on top of the material of the out casing 126. This layered arrangement forms a sheet of the various materials that may then be rolled (e.g., hand-rolled or machine-rolled) forming a long cylindrical shape. The resulting cylindrical shape may the be cut at desired intervals along the axial length of the shape to form individual filters, such as filter 120.

The filter 120 can have a recess 128. The recess 128 can be formed in a surface of the filter 120 along a curved face extending from the first end and the second end.

Figure 3:
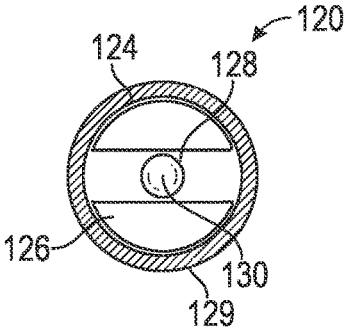
FIG. 3 is a cross-sectional view of an embodiment of the filter taken along the line A-A of FIG. 1.

FIG. 3 is a cross-sectional view of an embodiment of the filter 120 taken along the line A-A of FIG. 1. The recess 128 can be a cavity or orifice bored, punched, or otherwise formed in the surface of the filter wrapper 124. The recess 128 can extend into the cylindrical body of the filter 120. In some implementations, the recess 128 can penetrate the wrapper 124 and extend radially through the filter element 126. The recess 128 can penetrate both the filter wrapper 124 and the filter element 126 extending completely through the filter 120.

In other implementations, the recess 128 may not penetrate the wrapper 124 and thus be an indentation on the surface of the wrapper 126 and the filter 120. In general, a capsule 130 can be set within the recess 128 and thus contained within the recess 128 by the outer casing 129.

The recess 128 can be sized to receive the capsule 130. The capsule 130 can be a flavor capsule containing a flavoring agent. The capsule 130 can be a gelatin capsule. In other implementations, the capsule 130 can be formed from vegetable-based materials (e.g., a vegetable capsule). The flavoring agent can be a fluid operable to penetrate the filter element 126 and impart a flavor on the smoke drawn through the filter 120. The flavoring agent can be released when the capsule 130 is crushed. The flavoring agent within the capsule 130 can be, for example, a food grade essential oil or food grade candy oil. In some implementations, the flavoring agent can also include natural terpene liquid in various flavors (e.g., fruit or dessert flavors).

The recess 128 maybe be disposed at any axial position along the central axis 127 of the filter. For example, the recess 128 may be positioned closer to the first end 121 than the second end 123 along the axial direction. In this example, the first end 121 may be closer to a user's mouth than the second end 123, and thus the recess 128 and the flavor capsule may be adjacent to the mouth. In this arrangement, a user may have an improved experience as the flavoring agent is dispersed closer to the mouth of the user. In another example, the recess 128 may be positioned closer to second end 123 or anywhere in between the first end 121 and the second end 123.

In some examples, the capsule 130 is removably received within the recess 128. The recess 128 may be larger than the size of the capsule 130 such that the capsule 130 is moves within the recess 128. In these examples, the capsule 130 may be removed from the recess 128 and a different capsule inserted therein. As another example, the capsule 130 may be easily inserted into the recess 128 without applying a force to the capsule 130 and/or filter 130. This may minimize risk of bursting the capsule 130 and/or deforming the filter 120 during manufacture. Whereas, in some scenarios, if the capsule 130 is held in place by friction fit, insertion of the capsule 130 into the recess 128 may result in damage to the capsule 130 and/or filter 120 unless the insertion is performed with extra care.

In examples comprising the outer casing 129, the outer casing 129 may be configured to contain the capsule within the recess 128. For example, where the recess 128 penetrates the filter wrapper 124, the outer casing 129 may be provided to cover the cavity, orifice or opening of the recess 128. When the capsule 130 is housed within this recess 129, the outer casing 129 seals the opening and the capsule 130 is securely held within the recess 128. Similarly, where the recess 128 does not penetrate the filter wrapper 124 and the capsule 130 is set within an indentation in the filter wrapper 124, the outer casing 129 may cover the indentation and thereby cover the capsule 130. Accordingly, embodiments are able to securely contain the capsule 130 within the designated area of the filter 120 corresponding to the recess 128 through the use of the outer casing.

Figure 4:
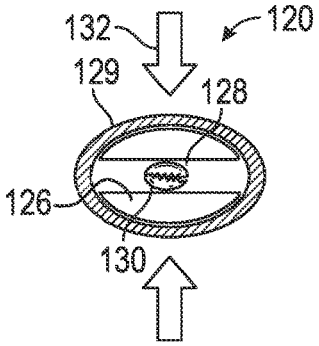
FIG. 4 is another view of the cross sectional view of FIG. 3.

FIG. 4 is another view of the cross section of FIG. 3. When an external force 132 (e.g., a pinching motion) is exerted on the filter 120 (e.g., on the filter 120 and, thusly, the capsule 130), the capsule 130 can be burst, releasing the flavoring agent into the filter element 126. The external force may be applied to one or more of the first end 121, second end 123, and anywhere therebetween such that the external force induces a pinching force applied to the capsule 130 within the filter element 126, thereby causing the capsule 130 to burst. The flavoring agent can be drawn into smoke that passes through the filter 120.

Figure 5:
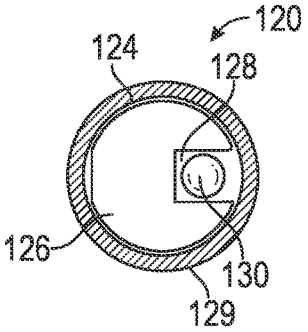
FIG. 5 is a cross-sectional view of another embodiment of the filter taken along the line A-A of FIG. 1.

FIG. 5 is a cross-section of another embodiment of the filter 120 taken along the line A-A of FIG. 1. In some implementations, the recess 128 can penetrate the wrapper 124 and extend radially into a portion of the filter element 126 but not all the way through the filter 120. Thus, the recess 130 can thus form a pocket within the filter 120.

While the illustrative examples herein provide for a recess 128 formed in the surface of the filter 120, embodiments herein need not be so limited. For example, the recess 128 may be formed within the filter element 126 and the capsule 130 inserted into the recess. In some examples, the filter 120 may be formed around the capsule 130, for example, by packing or rolling the filter element 126 around the capsule 130 forming recess 128 that contains the capsule 130. The filter wrapper 124 may then be applied and wrapped around the filter element 126. In another example, the filter element 126 may be placed on an unrolled filter wrapper 124 and the capsule 130 placed on the filter element 126 (e.g., in a central position of the filter element 126) and the filter wrapper 126 rolled to form the filer 120, thereby packing or rolling the filter element 126 around the capsule 130.

While FIGS. 3-5 each illustrate the filter 120 comprising outer casing 129, this is for illustrative purposes only. It will be appreciated the description in connection with FIGS. 3-5 each apply equally to embodiments of filter 120 with or without the outer casing 129.

Figure 6:
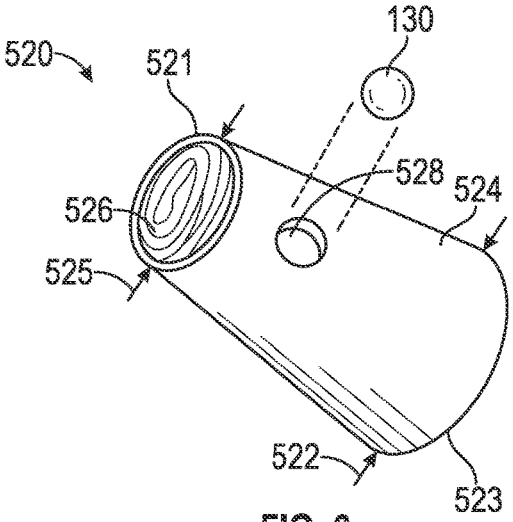
FIG. 6 is a perspective view of another embodiment of a filter.

FIG. 6 is a perspective view of another embodiment of a filter in accordance with embodiments herein. FIG. 6 depicts a filter 520 that is substantively similar to filter 120, except that filter 520 comprises a body having truncated conical shape. For example, filter 520 can have a first outer diameter 525 at a first end 521 and second outer diameter 522 at a second end 523. The first outer diameter 525 may be smaller than the second outer diameter 522 and the filter 520 may include an outer shape extending from the first end 521 to a second end 523 forming the truncated conical shape. Filter 520 can be received within an end of a truncated conical member in an interference or friction fit, for example, similar to that described in connection to FIG. 1 and as described below in connection to FIGS. 6-8. Unlike that described above, instead of a tubular member, filter 520 may be received at an end of a truncated conical member. In some examples, the filter 520 can be rolled into dried leaf or paper member (e.g., also referred to a wrap) when forming the truncated conical member.

The filter 520 can have a filter wrapper 524 (e.g., a plug wrap) enclosing a filter element 526. The filter element may be substantively similar to filter element 126 except that the filter element 526 corresponds to the truncated conical shape of the filter 520. That is, in some implementations, the filter element 526 can be held in the truncated conical shape by the filter wrapper 524. As with filter wrapper 124 of FIG. 1, the filter wrapper 524 can be a section of ordinary paper wrapped around the filter element 526. In other implementations, the filter 520 can be completely formed of corn husk without any paper. In some other implementations, the filter wrapper 524 can be one or more sections (e.g., lengths) of string formed from natural fibers. A string or band can be wrapped and tied around, for example, the ends of the filter element 526 to maintain a round shape.

The filter 520 can have a recess 528 sized to receive the capsule 130. The recess 528 may be substantively similar to that of recess 128 as described in connection to FIGS. 2-4. Accordingly, as described herein, when an external force 132 is exerted on the filter 520, the capsule 130 contained in recess 528 can be burst, releasing the flavoring agent into the filter element 526. The external force may be applied to one or more of the first end 521, second end 523, and anywhere therebetween such that the external force induces a pinching force applied to the capsule 530 within the filter element 526, thereby causing the capsule 530 to burst. The flavoring agent can be drawn into smoke that passes through the filter 520.

In some examples, the filter 520 may also comprise an outer casing (not shown) that is substantively similar to the outer casing 129 of FIG. 2. The outer casing for filter 520 has a truncated conical shape as described herein, opposed to the tubular shape of outer casing 129.

Figure 7:
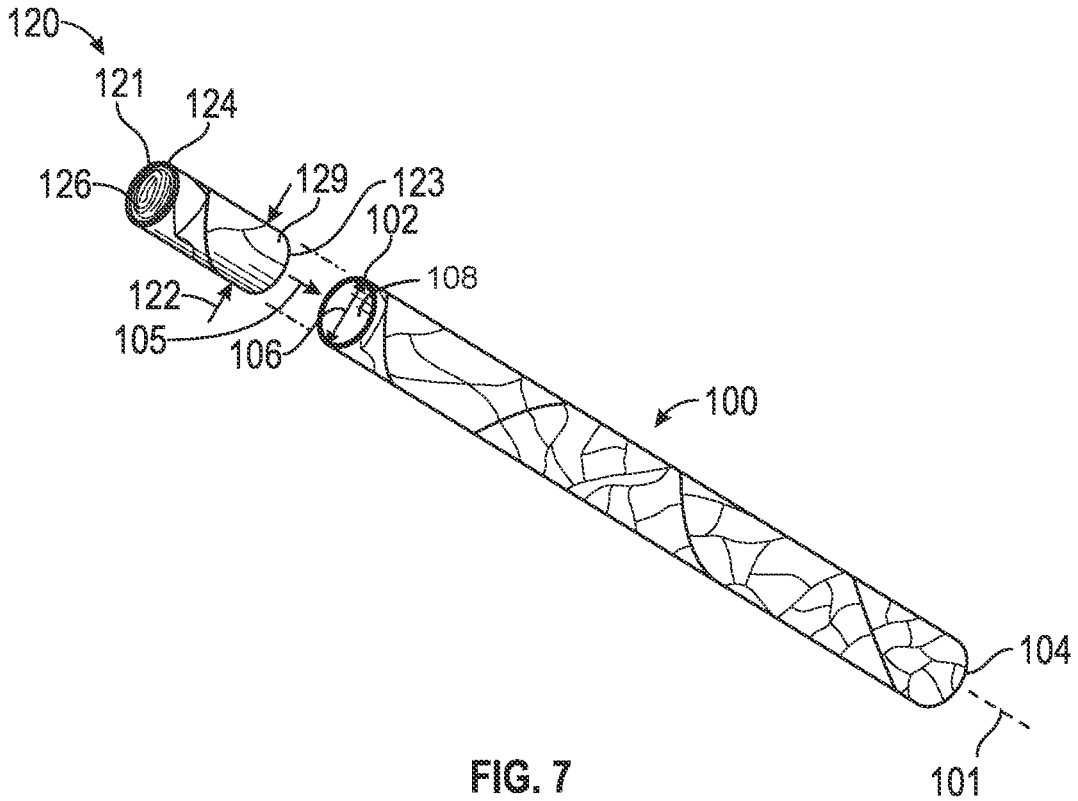
FIG. 7 is a perspective view of the filter received by a tubular member.
Figure 8:
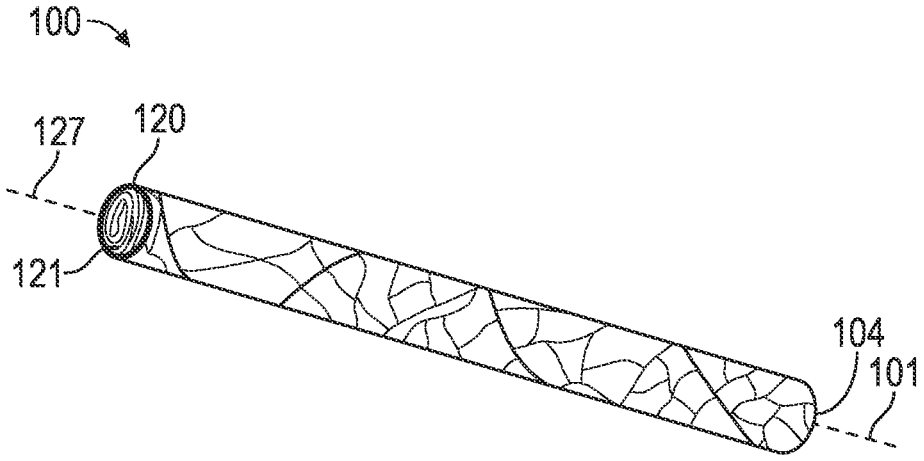
FIG. 8 is perspective view of the filter used with a hollow leaf tube.

FIG. 7 is a perspective view of an embodiment of a filter, according to the embodiments disclosed herein, being received by a tubular member. FIG. 8 is another perspective view of the tubular member of FIG. 7 having received the filter according to the embodiments herein. While FIGS. 7 and 8 each illustrate the filter 120 comprising outer casing 129, this is for illustrative purposes only. The following description of FIGS. 7 and 8 each apply equally to embodiments of filter 120 with or without the outer casing 129.

The tubular member 100 can be a leaf tube formed from a dried leaf or a wrapper for enclosing smoking material (such as plant based smoking material). The tubular member 100 may be formed by a wrapper (e.g., kraft paper, dried leaf, or the like) that is rolled to form the tubular member 100. The tubular member 100 can extend from a first end 102 to a second end 104. The first end 102 can be formed to receive the filter 120, forming a closed end of the tubular member 100. Receiving herein may refer to inserting the filter 120 into the first end 120 of the tubular member 100 (e.g., as shown by arrow 105). For example, where the filter 120 comprises the outer casing 129, the outer diameter 122 of the filter 120 can be received within end 102 of a tubular member 100 in an interference or friction fit. In another example, receiving as used herein may refer to placing the filter 120 onto the wrapper in an un-wrapped state and then forming the tubular member 100 around the filter 120. As another example, where the filter 120 does not include the outer casing 129, the outer diameter 125 of the filter 120 can be received within end 102 of a tubular member 100. That is, the filter 120 can be rolled into dried leaf or paper member when forming the tubular member 100.

The tubular member 100 can have a central axis 101 following an imaginary line through the center of the tubular member 100 from the first end 102 to the second end 104. A central axis 127 of the filter 120 may be substantially aligned with the central axis 101 of the tubular member 100.

The second end 104 can open into an elongated internal cavity 108 having an inner diameter 106. The internal cavity 108 can receive a smoking material 140 (see FIG. 8). In some implementations, dried leaf can be any natural plant leaf that can be rolled into the tubular member. In some examples, the wrapper or material forming the tubular member 100 can be a paper or tree or plant leaf such as, cordia, manjack, bocote, palm, or other leaves. Cordia is a primary example used herein, but is not limiting on the disclosure. Cordia can include flowering plants (e.g., shrubs and trees) in the borage family, Boraginaceae.

While the preceding description is made with reference to a tubular member 100 receiving the filter 120, it will be appreciated that the preceding examples applies equally to the filter 520 of FIG. 6. For example, instead of tubular member 100, a truncated conical member may be provided that receives the filter 520. A first end of the truncated conical member may have a first diameter that is smaller than the diameter of a second end forming a truncated conical shape. In this configuration, the outer diameter 522 of the filter 520 can be received within the first end of the truncated conical member in an interference or friction fit. As another example, the filter 520 can be rolled into dried leaf or paper member within the first end when forming the truncated conical member.

Furthermore, the filter 120 may be received at a first end of a truncated conical member, while the filter 520 may be received at a first end 102 of a tubular member 100

OTHER ASPECTS

The previous description is provided to enable any person skilled in the art to practice the various aspects described herein. Various modifications to these aspects will be readily apparent to those skilled in the art, and the generic principles defined herein may be applied to other aspects.

Thus, the claims are not intended to be limited to the aspects shown herein, but is to be accorded the full scope consistent with the language claims, wherein reference to an element in the singular is not intended to mean "one and only one" unless specifically so stated, but rather "one or more."

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A smoking accessory comprising:
- a filter comprising:
  - a body formed of rolled cordia leaf, the body extending from a first end to a second end, and
  - a recess formed in a surface of the body along a curved face extending from the first end to the second end, the recess extending radially into the body; and
- a capsule containing a flavoring agent disposed within the recess.

2. The smoking accessory of claim 1, wherein the filter comprises an outer casing that houses the body of the filter and, at least, covers the recess.

3. The smoking accessory of claim 1, wherein the filter comprises corn husk.

4. The smoking accessory of claim 1, wherein the filter comprises:
- a filter element having a filter body extending from the first end to the second end, the filter element formed by rolling cordia leaf, and
- a filter wrapper comprising cordia leaf, the filter wrapper extending from the first end to the second end, the filter wrapper configured to accommodate the filter element disposed therein.

5. The smoking accessory of claim 4, wherein the filter wrapper comprises rolled corn husk.

6. The smoking accessory of claim 5, wherein the filter element comprises rolled corn husk.

7. The smoking accessory of claim 5, wherein the filter wrapper comprises at least one piece of natural fiber string.

8. The smoking accessory of claim 1, wherein the body of the filter is a cylindrical body.

9. The smoking accessory of claim 1, wherein the body of the filter is a truncated conical body.

10. The smoking accessory of claim 1, wherein crushing the capsule disperses the flavoring agent within the filter to impart a flavor into smoke.

11. The smoking accessory of claim 1, wherein the recess completely penetrates the filter.

12. The smoking accessory of claim 1, wherein the recess is an indentation in the surface of the body of the filter.

13. A filter comprising:
- a body formed of cordia leaf;
- a recess formed in a surface of the body, the recess extending radially through the body; and
- a capsule containing a flavoring agent disposed within the recess.

14. The smoking accessory of claim 4, wherein the recess is formed in a surface of the filter wrapper along a curved face of the filter wrapper, the recess extending radially into the filter wrapper.

15. The smoking accessory of claim 1, wherein the flavoring agent disposed within the recess is an oil flavoring agent.

16. The smoking accessory of claim 1, wherein the flavoring agent disposed within the recess is a natural terpene liquid.

17. The filter of claim 13, wherein the flavoring agent is at least one of an oil flavoring agent and a natural terpene liquid.

* * * * *